US005167446A

United States Patent [19]

Haroutunian

[11] Patent Number: 5,167,446

[45] Date of Patent: Dec. 1, 1992

[54] FLASHLIGHT HAND GUN GRIP ACCESSORY

[76] Inventor: Vahe Haroutunian, 1682 Valleyview, Glendale, Calif. 91202

[21] Appl. No.: 807,503

[22] Filed: Dec. 16, 1991

[51] Int. Cl.[5] ..... F41G 1/34; F21L 15/08

[52] U.S. Cl. ..... 362/110; 42/103

[58] Field of Search ..... 362/109-114; 42/103, 106

[56] References Cited

U.S. PATENT DOCUMENTS 4,758,933 7/1988 Winberg et al. ..... 362/110
4,876,816 10/1989 Triplett ..... 362/110 X
5,042,186 8/1991 Bechtel ..... 362/110

*Primary Examiner*—Allen M. Ostrager

[57] ABSTRACT

A handgun grip accessory for attachment to the tubular casing of a flashlight to enable the person to hold the flashlight and at the same time hold and aim a pistol at an objected illuminated by the flashlight in a two-handed grip.

5 Claims, 2 Drawing Sheets

FLASHLIGHT HAND GUN GRIP ACCESSORY

BACKGROUND OF THE INVENTION

As pointed out in U.S. Pat. No. 4,758,933, in the United States and in many other countries, a police officer is required to carry a flashlight, a baton, and a fire arm, typically a hand gun. Police officers in Europe and in the United States are taught to fire their hand guns using a two-handed grip on the gun and in firing multiple shots, and it reduces re-coil since it is easier to hold the gun barrel steady when two hands are used for support.

During daylight hours or well lighted areas the foregoing procedure does not normally cause any problems. However, when an officer needs to aim his gun or be prepared to fire when approaching a suspect in darkened areas, it is difficult if not impossible to aim the gun correctly while at the same time using a flashlight to illuminate the area. If the flashlight is held in one hand and the gun in the other, the officer is at a disadvantage, since it is difficult to aim accurately using only one hand, and also since it is difficult to hold both the flashlight and the gun while firing rapidly at the target.

In view of the problems, discussed above, various attachment devices have been proposed in the prior art to secure flashlights to handguns, so that both hands are left free for aiming and firing the handgun. One typical arrangement is shown, for example, in U.S. Pat. No. 4,348,716, in which a bracket is provided for detachably mounting a flashlight on the hand grip of a gun. The type of arrangement shown in the patent, however, has a number of drawbacks. One major problem is the difficulty of rapidly and easily attaching the handgun and the flashlight together. Another drawback is the interference of the bracket with conventional two-handed firing of the hand gun. Also, the hand gun with the attached bracket does not fit into a standard holster.

In U.S. Pat. No. 4,758,933, the hand grip of the firearm is extended and is shaped to be fitted around the cylindrical casing of a flashlight, so that the flashlight and hand gun may be used together. The present invention achieves the desired intendment of U.S. Pat. No. 4,758,933, without any need to alter the conventional design of the hand gun.

In accordance with the present invention, an elongated bracket is releasably attached to the cylindrical casing of a flashlight, and extends radially outwardly from the casing. The bracket of the invention is shaped so that it may be grasped in one hand to direct the beam of the flashlight at a selected target. The bracket is also shaped to permit the hand gun to be held in the normal two-handed grip between the hands of the user while one hand grips the bracket itself. In this way, the hand gun may be aimed at the target illuminated by the beam of the flashlight.

BRIEF DESCRIPTION OF THE ILLUSTRATED EMBODIMENT

DETAILED DESCRIPTION OF THE ILLUSTRATED EMBODIMENT

Figure 1:
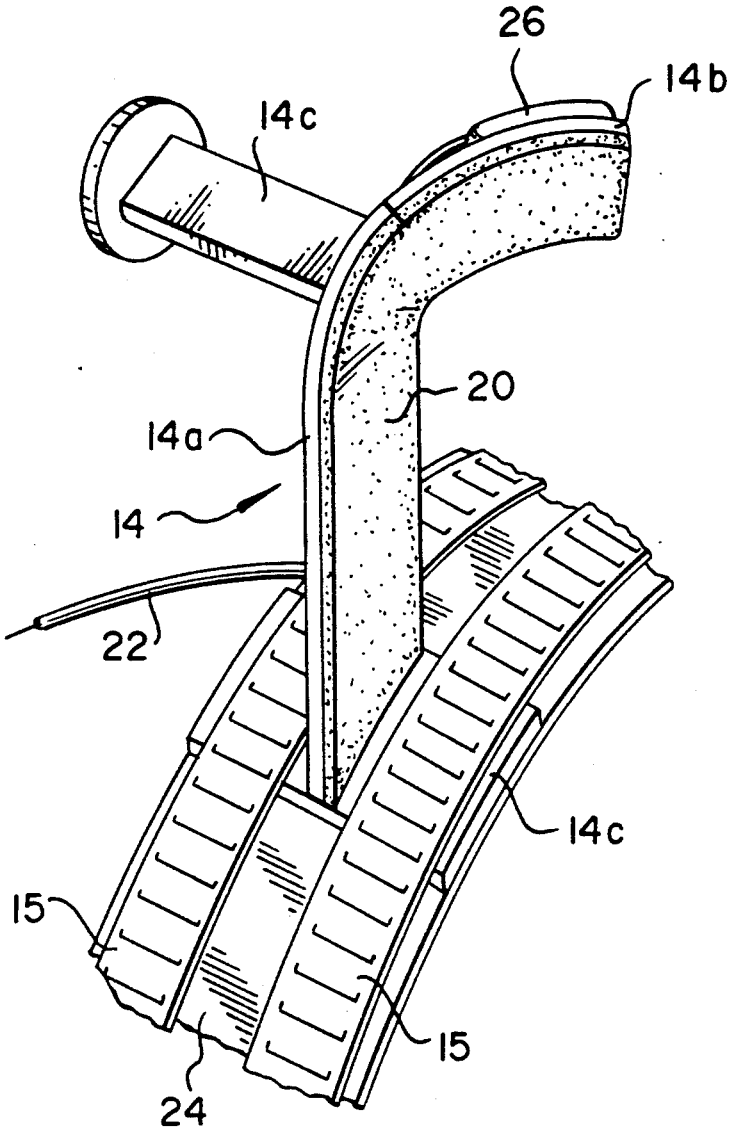
FIG. 1, is a perspective view of the bracket of the invention in one of its embodiments.
Figure 2:
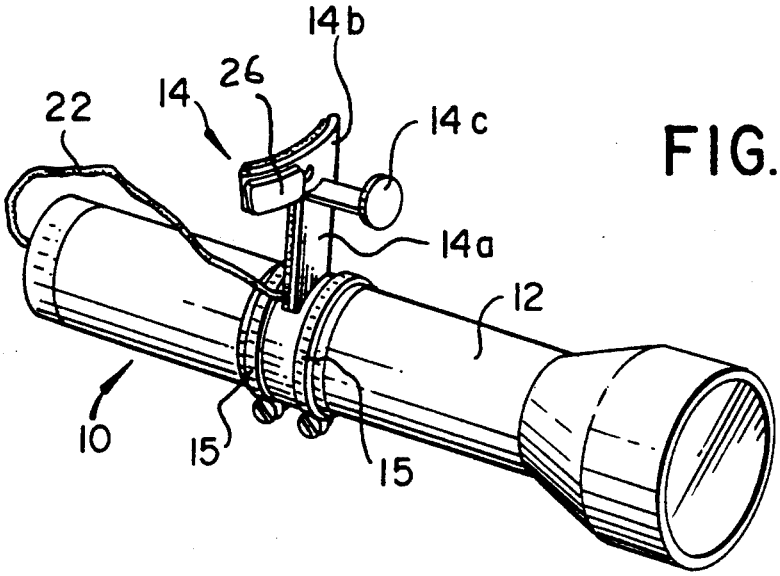
FIG. 2 is a perspective view of a flashlight and the bracket of FIG. 1, releasably mounted on the tubular casing of the flashlight and extending radially outwardly.

As shown in FIGS. 1 and 2, a flashlight 10 is provided having a tubular casing 12. An elongated bracket 14 is releasably mounted on the tubular casing 12 by means of an adjustable annular metal clamp 15 and extends radially outwardly from the casing.

The bracket 14 has an elongated central portion **14*a* which serves as a hand grip. A pedestal 14*c* is affixed on the end of the portion 14*a*, and a resilient pad 24 is affixed to the under side of pedestal. A clamp 15 is attached to pedestal 14*c* to clamp the bracket to the flashlight. A foam pad attached to the hand grip 14*a*, as shown in FIG. 1. The bracket has an upper arcuate-shaped portion 14B integral with the portion 14*a* and located at the distal end of portion 14*a*. A knob 14*c* is also provided at the upper end of the elongated portion 14*a* to assist the user in grasping the hand grip properly, in the manner shown in FIG. 3. Knob 14*c* assists the shooter in holding the flashlight without having to tighten the fingers of the left hand around portion 14*a*, thereby enabling the shooter to place the knuckles of the right hand against foam pad 20**.

Figure 3:
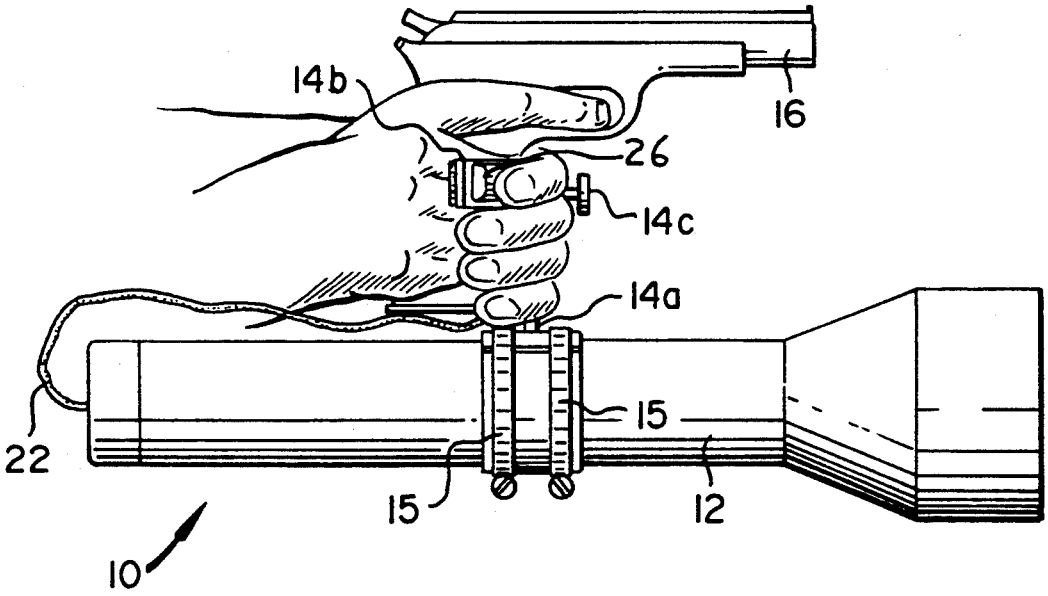
FIG. 3 is a view of the bracket grasped by the user to direct the flashlight at an area to be illuminated, with the hand gun gripped between the two hands of the user and aimed at the area illuminated by the flashlight.

As shown in FIG. 3, the user grasps the hand grip between his two hands with the knob **14*a* protruding between the fingers of one hand, and with a pistol 16 held between the two hands in a conventional two-handed grip. The knuckles of the right hand, as shown in FIG. 3, engage the arcuate portion 14*b*, which assists in properly aiming the handgun to the target illuminated by the flashlight. As shown in FIG. 3, knob 14*c*** extends between the fingers of the left hand to enable the user conveniently to support the weight of the flashlight.

Although the illustrated bracket is constructed for use by a right handed shooter, it is evident that it may be constructed for a left handed shooter.

As also shown in FIGS. 2 and 3, a switch 26 is provided at the distal end of the bracket 14. The switch is connected to the flashlight by wires 22. The switch is operated by a finger of the left hand, and it permits the user to turn the flashlight on and off at will.

The invention provides, therefore, a handgun grip for attachment to the tubular casing of a flashlight. The hand grip enables a person to hold the flashlight aimed at an area to be illuminated, and at the same time enables the person to hold and aim a handgun with a conventional two-handed grip at the illuminated object.

It will be appreciated that while a particular embodiment of the invention has been shown and described, modifications may be made. It is intended in the Claims to cover all modifications which come within the true spirit and scope of the invention.

I claim:

1. In combination: a flashlight; and a bracket mounted on said flashlight, said bracket comprising an elongated central portion extending outwardly from the flashlight to serve as a handgrip to be grasped between the hands of a user when a pistol is held between the hands of the user in a conventional two-handed grip and said bracket comprising a transverse arcuate portion affixed to the distal end the handgrip for receiving the knuckles of one hand of the user.

2. The combination defined in claim 1, in which the flashlight has a tubular casing and said bracket has a pedestal affixed to the end of the handgrip adjacent to the flashlight; and which includes an annular clamp extending around the tubular casing and around the pedestal for clamping the bracket to the casing.

3. The combination defined in claim 2, in which said bracket further comprises a knob affixed to the distal end of said handgrip and extending parallel to the longitudinal axis of said casing toward the front end of the flashlight in position to protrude through the fingers of one hand of the user.

4. The combination defined in claim 2, and which includes a resilient pad attached to the side of the handgrip facing the rear end of the flashlight.

5. The combination defined in claim 1, and which includes a switch mounted on the distal end of the handgrip and electrically connected to the flashlight.

* * * * *